US008608338B2

(12) United States Patent
Suzuki et al.

(10) Patent No.: US 8,608,338 B2
(45) Date of Patent: Dec. 17, 2013

(54) LIGHT SOURCE UNIT

(75) Inventors: Yuto Suzuki, Osaka (JP); Tomohisa Tajiri, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 78 days.

(21) Appl. No.: 13/094,958

(22) Filed: Apr. 27, 2011

(65) Prior Publication Data

US 2011/0273873 A1 Nov. 10, 2011

(30) Foreign Application Priority Data

May 6, 2010 (JP) ..... 2010-106464
Mar. 15, 2011 (JP) ..... 2011-056120

(51) Int. Cl.
*F21V 9/00* (2006.01)

(52) U.S. Cl.
USPC ..... 362/231; 362/230

(58) Field of Classification Search
USPC ..... 362/230, 231
See application file for complete search history.

(56) References Cited

U.S. PATENT DOCUMENTS 6,224,240 B1 * 5/2001 Shimizu et al. ..... 362/260
7,212,359 B2 * 5/2007 Richards et al. ..... 359/891
7,309,152 B2 * 12/2007 Huang ..... 362/612
7,703,943 B2 * 4/2010 Li et al. ..... 362/231
8,118,443 B2 * 2/2012 Huang et al. ..... 362/97.3
8,333,631 B2 * 12/2012 Emerson et al. ..... 445/24
2005/0135094 A1 * 6/2005 Lee et al. ..... 362/231
2007/0291467 A1 * 12/2007 Nagai et al. ..... 362/84
2008/0298053 A1 * 12/2008 Van Gorkom et al. ..... 362/231
2009/0290339 A1 * 11/2009 Chang et al. ..... 362/231
2010/0002440 A1 * 1/2010 Negley et al. ..... 362/249.14
2010/0008071 A1 * 1/2010 Kim et al. ..... 362/97.3
2010/0061081 A1 3/2010 Muschaweck et al.
2010/0079059 A1 * 4/2010 Roberts et al. ..... 313/503

FOREIGN PATENT DOCUMENTS

JP 2001-222242 A 8/2001
JP 2008-147563 A 6/2008
JP 2009-158903 A 7/2009
WO WO 2009/157999 A1 12/2009

OTHER PUBLICATIONS

European Search Report of corresponding EP Application No. 11 16 4691 dated Jun. 1, 2012.

* cited by examiner

*Primary Examiner* — David J Makiya
*Assistant Examiner* — Bryon T Gyllstrom
(74) *Attorney, Agent, or Firm* — Global IP Counselors

(57) ABSTRACT

A light source unit includes an LED mount bar and a set of LEDs. The LED mount bar has an inside channel that is located at a center portion of the LED mount bar, and outside channels that are located at outside portions of the LED mount bar, respectively. The set of LEDs is disposed in the inside channel and the outside channels. The set of LEDs is ranked into a plurality of chromaticity regions within a predetermined chromaticity range in a chromaticity coordinate system and ranked into a plurality of luminous flux ranges according to a luminous flux value of the LEDs, respectively. The inside channel including a plurality of first LEDs from a subset of the set of LEDs. The subset of LEDs is ranked in a predetermined chromaticity region of the chromaticity regions and ranked in a predetermined luminous flux range of the luminous flux ranges.

7 Claims, 3 Drawing Sheets

| Bin Rank (new) | Bin Rank (old) | lm |
|---|---|---|
| b | 22 | 22-23 |
| b | 23 | 23-24 |
| a | 24 | 24-25 |
| a | 25 | 25-26 |
| a | 26 | 26-27 |
| a | 27 | 27-28 |

FIG. 3

| | ch2,ch3 | ch1,ch4 |
|---|---|---|
| CIE | A | A or B |
| lm | a | a or b |
| NUMBER OF COMBINATIONS | ONE<br>A-a | FOUR<br>A-a, A-b<br>B-a, B-b |

FIG. 4

LIGHT SOURCE UNIT

CROSS-REFERENCE TO RELATED APPLICATIONS

This application claims priority to Japanese Patent Application No. 2010-106464 filed on May 6, 2010 and Japanese Patent Application No. 2011-56120 filed on Mar. 15, 2011. The entire disclosures of Japanese Patent Applications Nos. 2010-106464 and 2011-56120 are hereby incorporated herein by reference.

BACKGROUND

1. Field of the Invention

The present invention generally relates to a light source unit. More specifically, the present invention relates to a light source unit for a surface-emitting device 2. Background Information With LEDs (Light Emitting Diodes) employed in a light source unit for a surface-emitting device, individual differences in a production stage cause variation in chromaticity or luminous flux. In the case of a liquid crystal display module, such variation reaches a level at which a difference in contrast or color is clearly discernible by observing the display. Therefore, during manufacturing of a surface-emitting device with a built-in light source unit that uses LEDs as a light source, a ranking is applied to the large number of LEDs by using the chromaticity coordinates of a chromaticity diagram (xy chromaticity diagram in the CIE color system) from the International Commission on Illumination. A ranking is also applied in accordance with luminous flux values in the same manner for luminous flux (lm).

Conventionally, the LED chromaticity (CIE), luminous flux (lm), and forward voltage (Vf) specifications are finely restricted in order to make the emission color variation or the luminance of a surface-emitting device as uniform as possible. A light source unit in which a large number of LEDs having varying chromaticity or luminous flux are mixed together (mixing) is also sometimes used as a measure for making the emission color variation or the luminance as uniform as possible. In this approach, a mixing method is employed whereby LEDs having different chromaticity, luminous flux, and forward voltage specifications are aligned in alternating fashion.

A measure has been proposed for increasing the utilization rate of supplied LEDs having variation in the manufacture of a backlight (e.g., a surface-emitting device) for a liquid crystal module (see Japanese Laid-Open Patent Application Publication No. 2008-147563, for example). Various researches have also been conducted for reducing variation in emission color (see Japanese Laid-Open Patent Application Publication Nos. 2009-158903 and 2001-222242, for example).

SUMMARY

However, it has been discovered that when the conventional measure of closely restricting the chromaticity, luminous flux, and forward voltage specifications of the LEDs is taken in order to make the variation in emission color or luminous flux of the surface-emitting device as uniform as possible, problems arise in that only a limited number of LEDs can be used from among the large number of LEDs ranked according to the chromaticity coordinate system or luminous flux value. As a result, increased cost due to wasted LEDs is impossible to avoid.

It has also been discovered that when arbitrary LEDs are merely selected for use in the light source unit of the surface-emitting device from among a large number of LEDs which are finely ranked within a chromaticity range having a substantially rectangular border line in the chromaticity coordinate system, it is sometimes the case that most of the LEDs used in the light source unit belong to a chromaticity region that is ranked near a corner of the border line (in a position to one side in the chromaticity range), or that most of the LEDs belong to a luminous flux range that is ranked in a small range of luminous flux values. In these cases, the surface-emitting device no longer satisfies the chromaticity specification or the luminous flux specification, and is out of specification. Power consumption also increases in cases in which LEDs having a high forward voltage (Vf) are used in high concentrations.

Furthermore, it has also been discovered that during manufacturing of a surface-emitting device, it may be possible to reduce variations in overall emission color or luminous flux of the surface-emitting device while suppressing the occurrence of wasted LEDs by taking measures whereby each of the supplied large number of LEDs are finely ranked into a plurality of chromaticity regions within the above-mentioned chromaticity range, each of the LEDs are finely ranked into a plurality of luminous flux ranges according to the luminous flux value thereof, and the LEDs are ranked according to the forward voltage values thereof, and the LEDs belonging to each rank are then appropriately combined and the arrangement positions thereof are assigned in a strip-shaped bar of the light source unit.

However, in a case in which the supplied large number of LEDs are ranked into sixteen types of chromaticity regions having four lines and four rows in a chromaticity range, and ranked into six types of luminous flux ranges according to luminous flux value, and the LEDs are further ranked according to seven types of forward voltage values, for example, since there are a total of 672 possible combinations for these LEDs, it is nearly impossible to arrange the LEDs in assigned positions in a bar.

Moreover, it has also been discovered that in order to overcome this problem, it is useful to simplify the assignment of LED positions in the bar by reducing the number of ranks of the chromaticity regions or luminous flux ranges.

The present invention is conceived in light of the above-mentioned problems. One object of the present invention is to provide a light source unit in which all of the supplied LEDs can be used, and wasting of LEDs is suppressed in a case in which LEDs are supplied which have variations in chromaticity range or luminous.

In accordance with one aspect of the present invention, a light source unit includes an LED mount bar and a set of first LEDs. The LED mount bar has an inside channel that is located at a center portion of the LED mount bar, and outside channels that are located at outside portions of the LED mount bar, respectively. The outside portions are disposed longitudinal outside of the LED mount bar relative to the center portion, respectively. The set of LEDs is disposed in the inside channel and the outside channels. The set of LEDs is ranked into a plurality of chromaticity regions within a predetermined chromaticity range in a chromaticity coordinate system and ranked into a plurality of luminous flux ranges according to a luminous flux value of the LEDs, respectively. The inside channel including a plurality of first LEDs from a subset of the set of LEDs. The subset of LEDs is ranked in a predetermined chromaticity region of the chromaticity regions and ranked in a predetermined luminous flux range of the luminous flux ranges.

With the light source unit, it is possible to provide a light source unit in which all of the supplied LEDs can be used, and wasting of LEDs is suppressed in a case in which LEDs are supplied which have variations in chromaticity range or luminous.

These and other objects, features, aspects and advantages will become apparent to those skilled in the art from the following detailed description, which, taken in conjunction with the annexed drawings, discloses a preferred embodiment.

BRIEF DESCRIPTION OF THE DRAWINGS

Referring now to the attached drawings which form a part of this original disclosure:

FIG. 3 is a diagram illustrating ranking of luminous flux ranges by luminous flux value;

FIG. 4 is a diagram illustrating types of chromaticity regions and luminous flux ranges of the LEDs allocated to each channel of the light source unit of the surface-emitting device.

DETAILED DESCRIPTION OF EMBODIMENTS

A preferred embodiment will now be explained with reference to the drawings. It will be apparent to those skilled in the art from these disclosures that the following descriptions of the preferred embodiment are provided for illustration only and not for the purpose of limiting the invention as defined by the appended claims and their equivalents.

Figure 1:
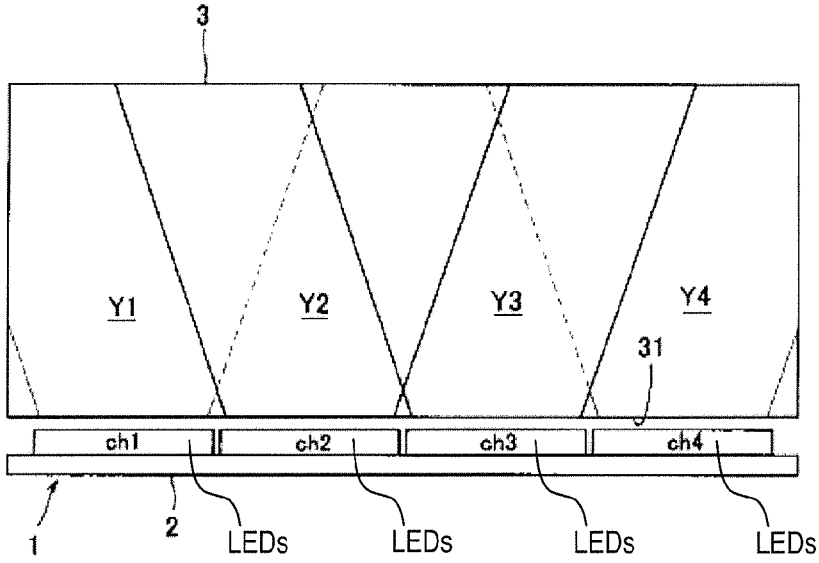
FIG. 1 is a top plan view of a light source unit for a surface-emitting device in accordance with one embodiment.

FIG. 1 is a top plan view of a light source unit 1 for a surface-emitting device. The surface-emitting device includes a light source unit 1 and a light guide plate 3. The light source unit 1 includes a strip-shaped bar (e.g., LED mount bar) 2 and LEDs (Light Emitting Diodes) that are mounted so as to be aligned in the bar 2. The LEDs are mounted on the bar 2 such that the LEDs are disposed facing a light entrance surface 31 of the light guide plate 3. With this surface-emitting device, light exiting the LEDs is introduced to the light guide plate 3 through the light entrance surface 31, and is surface-emitted by a surface of the light guide plate 3 by the operation of the light guide plate 3 and an optical sheet (not shown) or the like. In other words, the surface-emitting device emits light from the surface (an upper surface that intersects with the light entrance surface 31) of the light guide plate 3 as an edge light type backlight device for a liquid crystal display. Of course, the surface-emitting device can be used as a direct light type backlight device when a plurality of the bars 2 is aligned as a plane to emit light from a surface that is opposite the light entrance surface 31.

In the surface-emitting device shown in FIG. 1, the LEDs included in the light source unit 1 are sorted into and allocated to individual channels which are aligned in a plurality of locations in a longitudinal direction of the bar 2. Specifically, four channels indicated as ch1, ch2, ch3, ch4 are partitioned and formed in four locations in the longitudinal direction of the bar 2. A required number of LEDs are assigned positions and arranged for each of the channels ch1 through ch4. In the surface-emitting device, the specifications of the LEDs (e.g., first LEDs, third LEDs) arranged in the channels ch2, ch3 (e.g., inside channel and second inside channel) at the center (e.g., center portion) in the longitudinal direction of the bar 2 of the light source unit 1 easily affect the overall specifications of the surface-emitting device as a module. Consequently, the basic concept of the surface-emitting device is that LEDs having a high chromaticity specification and luminous flux specification (e.g., the subset of LEDs being ranked in a predetermined chromaticity region and ranked in a predetermined luminous flux range) are arranged in the channels ch2, ch3, and LEDs (e.g., second LEDs) arbitrarily selected from among a supplied large number of LEDs (e.g., set of LEDs) are arranged in the channels ch1, ch4 (e.g., outside channels) on both sides. In FIG. 1, the reference symbols Y2 and Y3 refer to the light exiting from the LEDs included in the channels ch2, ch3, and Y1 and Y4 refer to the light exiting from the LEDs included in the channels ch1, ch4.

The LEDs allocated to the channels ch1 through ch4 in four locations are selected from among the supplied large number of LEDs that are ranked into a plurality of chromaticity regions within a chromaticity range (e.g., predetermined chromaticity range) S (see FIG. 2) in a chromaticity coordinate system, and ranked into a plurality of luminous flux ranges according to the luminous flux value thereof. The supplied large number of LEDs ranked into the chromaticity regions or the luminous flux ranges herein are a group of LEDs (e.g., a set of LEDs) supplied to manufacturing steps in the manufacturing of the surface-emitting device.

Figure 2:
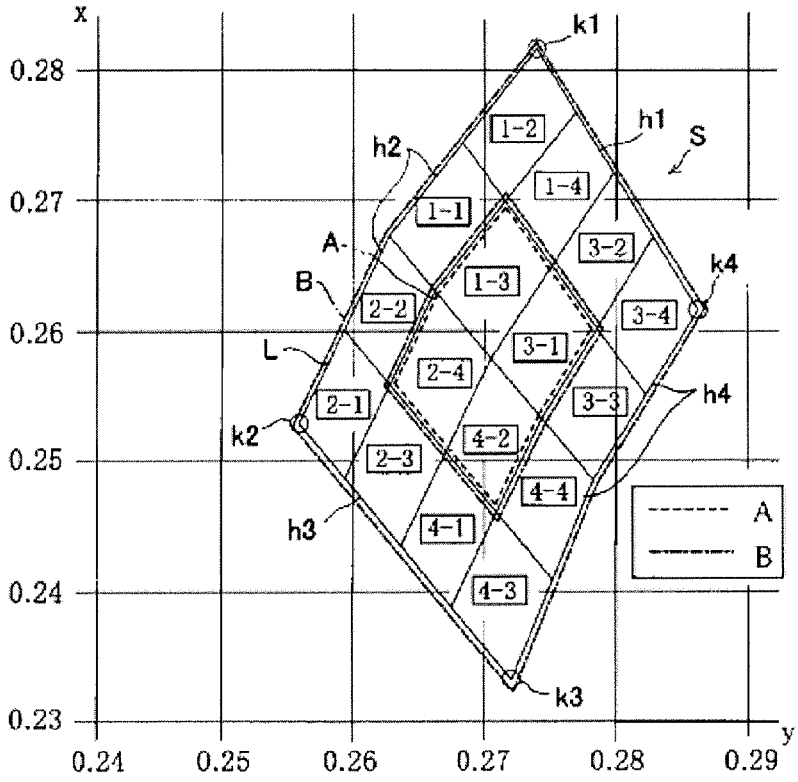
FIG. 2 is a chromaticity diagram illustrating ranking of LEDs in a chromaticity range of a chromaticity coordinate system.

FIG. 2 is a chromaticity diagram illustrating the ranking of the supplied large number of LEDs in the chromaticity range S in the chromaticity coordinate system. FIG. 3 is a diagram illustrating the ranking of the supplied large number of LEDs into the luminous flux ranges. The chromaticity diagram illustrated FIG. 2 is a diagram in which color information of the supplied LEDs is mapped on a two dimensional diagram referred to as the CIE 1931 chromaticity diagram. Coordinates are used to bound or define regions (e.g., chromaticity regions) in terms of where the LEDs should be positioned on the CIE 1931 chromaticity diagram. The LEDs are supplied by an LED manufacturer based on the LED manufacturer's tables of bounding coordinates for the regions they have defined. For example, the LEDs are supplied by an LED manufacture when a user specifies the chromaticity range S based on the coordinates of the CIE 1931 chromaticity diagram or the LED manufacture's code indicating the chromaticity range S. FIG. 2 illustrates an example of the chromaticity range S. Thus, the values of the coordinates of FIG. 2 specifying the chromaticity range S can be different values when the user orders different LEDs having different specification. Ranking is applied to the LEDs by using the chromaticity coordinates of the chromaticity diagram (e.g., xy chromaticity diagram in the CIE color system of FIG. 2) from the International Commission on Illumination. The LED manufacture or the user ranks the LEDs to the chromaticity regions.

In the chromaticity diagram of FIG. 2, the supplied large number of LEDs is finely ranked into sixteen types of chromaticity regions having four lines and four rows within the chromaticity range S in the chromaticity coordinate system. In the example shown in FIG. 2, the sixteen types of chromaticity regions are ranked in the following manner. Specifically, the supplied large number of LEDs is ranked into sixteen types of chromaticity regions inside the chromaticity range S which has a substantially rectangular border line L in the chromaticity coordinate system. Reference symbols are paired with the sixteen type of chromaticity regions in a "parent number-daughter number" format as shown below:

1-1, 1-2, 1-3, 1-4, 2-1, 2-2, 2-3, 2-4,
3-1, 3-2, 3-3, 3-4,
4-1, 4-2, 4-3, 4-4.

As is apparent from the chromaticity diagram of FIG. 2, the ranks 1-1, 1-2, 1-3, 1-4 having the parent number "1" are positioned closer to one corner k1 in the chromaticity range S surrounded by the substantially rectangular border line L. The range of chromaticity regions belonging to the three ranks 1-1, 1-2, 1-4 therein border on the mutually adjacent two edges h1, h2 of the border line L. The ranks 2-1, 2-2, 2-3, 2-4 having the parent number "2" are positioned closer to another corner k2 in the chromaticity range S surrounded by the substantially rectangular border line L. The range of chromaticity regions belonging to the three ranks 2-1, 2-2, 2-3 therein border on the mutually adjacent two edges h2, h3 of the border line L. The ranks 3-1, 3-2, 3-3, 3-4 having the parent number "3" are positioned closer to another corner k4 in the chromaticity range S surrounded by the substantially rectangular border line L. The range of chromaticity regions belonging to the three ranks 3-2, 3-3, 3-4 therein border on the mutually adjacent two edges h4, h1 of the border line L. The ranks 4-1, 4-2, 4-3, 4-4 having the parent number "4" are positioned closer to another corner k3 in the chromaticity range S surrounded by the substantially rectangular border line L. The range of chromaticity regions belonging to the three ranks 4-1, 4-3, 4-4 therein border on the mutually adjacent two edges h3, h4 of the border line L.

In a manufacturing step for the surface-emitting device according to this embodiment, all of the chromaticity regions included in the chromaticity range S, i.e., all of the chromaticity regions having the parent numbers 1 through 4 and the daughter numbers 1 through 4, are ranked into two levels which include a first chromaticity region group (e.g., first chromaticity region) A positioned at the center in the chromaticity coordinate system, and a second chromaticity region group (e.g., second chromaticity region) B positioned so as to surround the first chromaticity region group A. In this embodiment, four types of chromaticity regions that include the ranks 1-3, 2-4, 3-1, and 4-2 are included in the first chromaticity region group A. The LEDs included in the first chromaticity region group A are LEDs having a high chromaticity specification that are distributed adjacent to each other at the center of the chromaticity range S. In other words, the first chromaticity region group A is located adjacent or close to an ideal values of the coordinates, such as (x, y)= (0.26, 0.27) for example, that all the LEDs should have on the CIE 1931 chromaticity diagram of FIG. 2. The twelve types of chromaticity regions which include the ranks 1-1, 1-2, 1-4, 2-1, 2-2, 2-3, 3-2, 3-3, 3-4, 4-1, 4-3, and 4-4 are included in the second chromaticity region group B. The LEDs included in the second chromaticity region group B have a lower specification than the first chromaticity region group A and are distributed adjacent to each other in positions surrounding the periphery of the first chromaticity region group A. In other words, the second chromaticity region group B is located farther from the ideal values of coordinates than the first chromaticity region group A.

FIG. 3 illustrates the ranking of the luminous flux ranges of the supplied large number of LEDs. The supplied large number of LEDs is finely ranked into six types of luminous flux ranges by the reference symbols 22, 23, 24, 25, 26, and 27, as illustrated in the "Bin Rank (old)" column in FIG. 3.

As is apparent from FIG. 3, the luminous flux (lm) of the LEDs ranked as the luminous flux range of reference symbol 22 is 22 to 23, the luminous flux (lm) of the LEDs ranked as the luminous flux range of reference symbol 23 is 23 to 24, the luminous flux (lm) of the LEDs ranked as the luminous flux range of reference symbol 24 is 24 to 25, the luminous flux (lm) of the LEDs ranked as the luminous flux range of reference symbol 25 is 25 to 26, the luminous flux (lm) of the LEDs ranked as the luminous flux range of reference symbol 26 is 26 to 27, and the luminous flux (lm) of the LEDs ranked as the luminous flux range of reference symbol 27 is 27 to 28.

In a manufacturing step for the surface-emitting device according to this embodiment, the six types of luminous flux ranges 22 through 27 are ranked into two levels which include a first luminous flux range group (e.g., first luminous flux range) a having large luminous flux values, and a second luminous flux range group (e.g., second luminous flux range) b having smaller luminous flux values than the first luminous flux range group a, as shown in the "Bin Rank (new)" column of FIG. 3. In this embodiment, four types of luminous flux ranges 24 through 27 are included in the rank of the first luminous flux range group a. The LEDs included in the first luminous flux range group a are the LEDs having a high luminous flux specification that are included in the luminous flux ranges 24 through 28. Two types of luminous flux ranges 22 and 23 are included in the rank of the second luminous flux range group b. The LEDs included in the second luminous flux range group b are the LEDs included in the luminous flux ranges 22 and 23, and have low specifications in relation to the LEDs that are included in the first luminous flux range group a.

In the surface-emitting device according to this embodiment, the required number of LEDs are sorted and arranged among the four channels ch1, ch2, ch3, ch4 which are partitioned and formed in four locations in the longitudinal direction of the bar 2 of the light source unit 1, in accordance with the basic concept described with reference to FIG. 1. Specifically, the required number of LEDs arbitrarily selected from the first chromaticity region group A and the first luminous flux range group a are allocated to the inside channels ch2, ch3 in two locations at the center in the longitudinal direction of the bar 2. LEDs arbitrarily selected from the entire range of the first and second chromaticity region groups A, B and the first and second luminous flux range groups a, b are allocated to the outside channels ch1, ch4 in two locations positioned on both sides of the inside channels ch2, ch3. Specifically, the outside channels are located at outside portions of the bar 2. The outside portions are disposed longitudinal outside of the bar 2 relative to the center of the bar 2, respectively.

FIG. 4 illustrates the types of chromaticity region groups according to the chromaticity (CIE), and the types of luminous flux range groups according to the luminous flux (lm) of the LEDs that are sorted for each channel. As illustrated in FIG. 4, by following the steps described above, LEDs arbitrarily selected from the first chromaticity region group A are allocated to the inside channels ch2, ch3 of the bar 2, LEDs arbitrarily selected from the entire range of the first and second chromaticity region groups A, B are allocated to the outside channels ch1, ch4, all of the LEDs included in the inside channels ch2, ch3 belong to the first luminous flux range group a having a large luminous flux value, and the LEDs included in the outside channels ch1, ch4 are arbitrarily selected from the entire range of the first and second luminous flux range groups a, b.

In the surface-emitting device according to the embodiment described above, LEDs are sorted into and allocated to the individual channels aligned at four locations in the longitudinal direction of the bar 2 of the light source unit 1. Therefore, there is no need to separately determine the arrangement positions of individual LEDs in the bar 2, and the arrangement position of each ranked LED can be determined for each channel. The work required to arrange the LEDs is therefore reduced, and a step for arranging the LEDs can be omitted.

The number of combinations is also reduced from 672 for combinations of chromaticity regions, luminous flux ranges, and forward voltages to two, for the first and second groups. Consequently, it is sufficient merely to allocate the LEDs obtained by the single combination A-a of the first chromaticity region group A and the first luminous flux range group a to the inside channels ch2, ch3, as shown in FIG. 4. It is also sufficient merely to allocate the LEDs obtained by the four combinations A-a, A-b, B-a, and B-b of the first and second chromaticity region groups A, B and the first and second luminous flux range groups a, b to the outside channels ch1, ch4. Consequently, the operations of combining and arranging LEDs in assigned positions in each channel of the bar 2 are simplified.

Furthermore, since all of the LEDs distributed in the chromaticity range S are used in the light source unit 1, wasting of LEDs is less prone to occur. Thus, cost can be reduced by eliminating the need for using segmented specifications for each LED, and conditions in which chromaticity or luminous flux is out of specification can be avoided.

In this embodiment, an example is described in which the bar 2 is divided into four channels ch1, ch2, ch3, ch4, but the bar 2 can also be divided into three channels, or into five or more channels. In a case in which the bar 2 is divided into three channels, the one center channel corresponds to the inside channel, and the two channels on both sides thereof correspond to the outside channels. In a case in which the bar 2 is divided into five channels, the center three channels correspond to the inside channels, and the two channels on both sides thereof correspond to the outside channels.

With the surface-emitting device, a large number of LEDs are ranked into the chromaticity regions within the chromaticity range S in the chromaticity coordinate system, and are ranked into the luminous flux ranges according to the luminous flux value thereof. The required number of LEDs are selected from among the large number of LEDs are mounted on the light source unit 1 so as to be aligned in the strip-shaped bar 2.

Individual channels ch1, ch2, ch3, ch4 are included, to which the required number of LEDs are sorted and allocated. The channels ch1, ch2, ch3, ch4 are aligned in a plurality of locations in the longitudinal direction of the bar 2. The channels ch1, ch2, ch3, ch4 are partitioned into the inside channels ch2, ch3 positioned at the center in the alignment direction of the channels in a plurality of locations, and the outside channels ch1, ch4 positioned on both sides of the inside channels ch2, ch3.

The LEDs having a high chromaticity specification and luminous flux specification selected from all of the chromaticity regions and luminous flux ranges are allocated to the inside channels ch2, ch3.

Through this configuration, since the required number of LEDs included in the light source unit 1 are sorted and allocated to individual channels ch1, ch2, ch3, ch4 aligned in a plurality of locations in the longitudinal direction of the bar 2, there is no need to separately determine the arrangement positions of individual LEDs in the bar2, and the arrangement positions of individual LEDs can be determined for each channel. The work required to arrange the LEDs is therefore reduced, and a step for arranging the LEDs can be omitted.

The chromaticity specification and luminous flux specification of the LEDs allocated to the inside channels ch2, ch3 of the bar 2 of the light source unit 1 are high, and the specifications of the LEDs allocated to the inside channel ch2, ch3 affect the overall specifications of the surface-emitting device as a module. Thus, the chromaticity specification and luminous flux specification required in the surface-emitting device are satisfied. In other words, allocating LEDs that are arbitrarily selected from all of the plurality of chromaticity regions and the plurality of luminous flux ranges to the outside channels ch1, ch4 does not cause the surface-emitting device to be out of specification.

The LEDs arbitrarily selected from all of the chromaticity regions and luminous flux ranges are allocated to the outside channels ch1, ch4. Through this configuration, the LEDs having a high chromaticity specification and luminous flux specification selected from all of the chromaticity regions and luminous flux ranges are allocated to the inside channels ch2, ch3, and the LEDs arbitrarily selected from all of the chromaticity regions and luminous flux ranges (i.e., a mixture of LEDs having high chromaticity and luminous flux specifications and LEDs having low chromaticity and luminous flux specifications) are allocated to the outside channels ch1, ch4. All of the supplied large number of LEDs can therefore be used, and wasting of LEDs is suppressed.

With the surface-emitting device, the LEDs arbitrarily selected from the first chromaticity region group A are allocated to the inside channels ch2, ch3, the first chromaticity region group A is obtained by ranking all of the chromaticity regions into two levels which include the first chromaticity region group A positioned at the center in the chromaticity coordinate system, and the second chromaticity region group B positioned so as to surround the first chromaticity region group A. Furthermore, all of the LEDs included in the inside channels ch2, ch3 belong to the first luminous flux range group a obtained by ranking the plurality of luminous flux ranges into two levels which include the first luminous flux range group a having large luminous flux values, and the second luminous flux range group b having smaller luminous flux values than the first luminous flux range group a.

Through this configuration, the chromaticity regions are ranked into two levels which include a first chromaticity region group and a second chromaticity region group, and segmentation of LED specifications is prevented. The luminous flux ranges are also ranked into two levels which include a first luminous flux range group and a second luminous flux range group, and segmentation of LED specifications is prevented. Therefore, even when the supplied large number of LEDs are finely ranked into sixteen types of chromaticity regions having four lines and four rows in a chromaticity range in the chromaticity coordinate system, and finely ranked into six types of luminous flux ranges according to luminous flux value, the LEDs for arrangement in assigned positions in the bar need only be selected from first or second chromaticity region group and the first or second luminous flux range group ranked into two levels, and assignment of positions is facilitated.

Through this configuration as well as in the configuration described above, the LEDs allocated to the inside channels ch2, ch3 of the bar 2 of the light source unit 1 satisfy the chromaticity specification and luminous flux specification required in the surface-emitting device. The specifications of the LEDs allocated to the inside channels ch2, ch3 affect the overall specifications of the surface-emitting device as a module. Thus, even if the LEDs that do not satisfy the required specifications are allocated to the outside channels ch1, ch4, the LEDs do not cause the surface-emitting device to be out of specification. Since the LEDs arbitrarily selected from all of the chromaticity regions and luminous flux ranges are also allocated to the outside channels ch1, ch4, all of the supplied large number of LEDs can be used, and wasting of LEDs is suppressed.

The LEDs arbitrarily selected from the entire range of the first and second chromaticity region groups A, B are allocated to the outside channels ch1, ch4, and the LEDs included in the outside channels ch1, ch4 are arbitrarily selected form the entire range of the first and second luminous flux range groups a, b. Through this configuration, since the LEDs arbitrarily selected from all of the plurality of chromaticity regions and plurality of luminous flux ranges are allocated to the outside channels ch1, ch4, all of the supplied large number of LEDs can be used, and wasting of LEDs is suppressed.

The required number of LEDs included in the light source unit 1 are sorted and allocated to four channels ch1, ch2, ch3, ch4 aligned in the longitudinal direction of the bar 2. The two channels at the center of the four channels are designated as the inside channels ch2, ch3, and the two channels positioned on both sides of the two channels are designated as the outside channels ch1, ch4.

Figure 5:
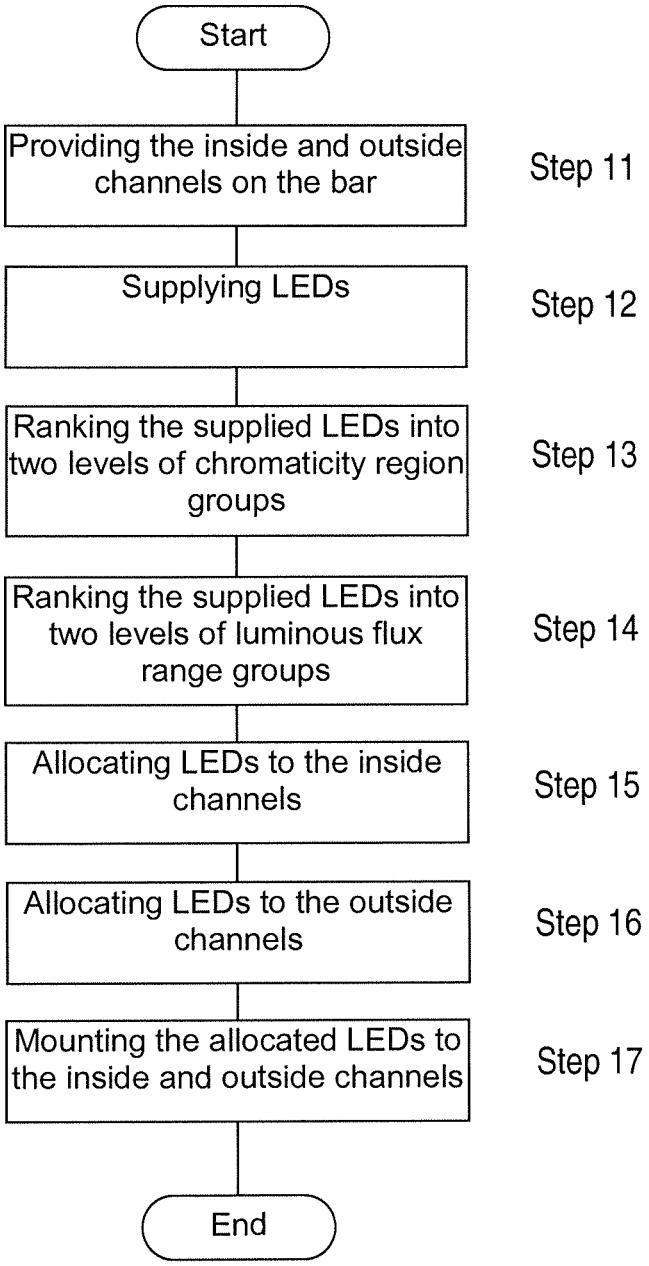
FIG. 5 is a flowchart illustrating a method for making the light source unit in accordance with one embodiment.

As illustrated in FIG. 5, the surface-emitting device can be manufactured by the following steps:

Partitioning and forming channels ch1, ch2, ch3, ch4 for division and allocation of the required number of LEDs in the plurality of locations in the longitudinal direction of the bar 2 (e.g., providing the inside channels and the outside channels on an LED mount bar) (Step 11);

Supplying all of the LEDs (e.g., providing a set of LEDs) (Step 12);

Ranking all of the supplied LEDs into two levels of chromaticity regions which include the first chromaticity region group A positioned at the center in the chromaticity coordinate system, and the second chromaticity region group B positioned so as to surround the first chromaticity region group A (Step 13);

Ranking all of the supplied LEDs into two levels of luminous flux ranges which include the first luminous flux range group a having large luminous flux values, and the second luminous flux range group b having smaller luminous flux values than the first luminous flux range group a (Step 14);

Allocating LEDs arbitrarily selected from LEDs that are ranked in the first chromaticity region group A and the first luminous flux range group a to the inside channels ch2, ch3 positioned at the center in the alignment direction of the channels formed at the plurality of locations (e.g., selecting a plurality of first LEDs from a subset of the set of LEDs) (Step 15);

Allocating LEDs arbitrarily selected from LEDS that are ranked in the entire range of the first and second chromaticity region groups A, B and the first and second luminous flux range groups a, b to the outside channels ch1, ch4 positioned on both sides of the inside channels ch2, ch3 (Step 16); and mounting the allocated LEDs to the inside channels ch2, ch3 and the outside channels ch1, ch4, respectively (e.g., mounting the first LEDs on the inside channel) (Step 17).

With the surface-emitting device, a surface-emitting device can be provided in which all of the supplied large number of LEDs can be used, and conditions in which chromaticity or luminous flux is out of specification are eliminated in a case in which a large number of LEDs are supplied which have variations due to individual differences in chromaticity range, luminous flux, or other characteristics. Consequently, wasting of LEDs among the supplied LEDs is suppressed, and cost can be reduced. Cost can also be reduced by obviating the need for the complicated work of selecting LEDs having the desired specifications from among the large number of LEDs having segmented specifications.

With the surface-emitting device, the LEDs for the inside channels ch2, ch3 are selected only from the subset of the supplied LEDs that is ranked in the first chromaticity region group A and ranked in the first luminous flux range group a, and the LEDs for the outside channels ch1, ch4 are selected from a combination of the entire range of the first and second chromaticity region groups A, B and the entire range of the first and second luminous flux range groups a, b. In other words, the LEDs for the outside channels ch1, ch4 are selected from a combination of the subset of the supplied LEDs and outside of the subset of the supplied LEDs. On the other hand, the LEDs for the outside channels ch1, ch4 can be selected only from outside of the subset of the supplied LEDs. In other words, the LEDs for the outside channels ch1, ch4 can be selected only from another subset (or outside of the subset) of the supplied LEDs that is ranked in the second chromaticity region group B and ranked in the second luminous flux range group b.

GENERAL INTERPRETATION OF TERMS

In understanding the scope of the present invention, the term "comprising" and its derivatives, as used herein, are intended to be open ended terms that specify the presence of the stated features, elements, components and groups, but do not exclude the presence of other unstated features, elements, components and groups. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the present invention, the following directional terms "forward, rearward, above, downward, vertical, horizontal, below and transverse" as well as any other similar directional terms refer to those directions of a surface-emitting device equipped with the present invention. Accordingly, these terms, as utilized to describe the present invention should be interpreted relative to a surface-emitting device equipped with the present invention as used in the normal operating position.

While a preferred embodiment have been chosen to illustrate the present invention, it will be apparent to those skilled in the art from these disclosures that various changes and modifications can be made herein without departing from the scope of the invention as defined in the appended claims. Furthermore, the foregoing descriptions of the preferred embodiment according to the present invention are provided for illustration only, and not for the purpose of limiting the invention as defined by the appended claims and their equivalents.

What is claimed is:

1. A light source unit comprising:

an LED mount bar having first and second inside channels that are located at a center portion of the LED mount bar such that the first and second inside channels are arranged adjacent to each other on opposite sides of a longitudinal center point of an entire length of the LED mount bar, and first and second outside channels that are located at outside portions of the LED mount bar, respectively, with the outside portions being disposed longitudinal outside of the LED mount bar relative to the center portion, respectively; and a set of LEDs disposed in the first and second inside channels and the first and second outside channels, the set of LEDs being ranked into a plurality of chromaticity regions within a predetermined chromaticity range in a chromaticity coordinate system and ranked into a plurality of luminous flux ranges according to a luminous flux value of the LEDs, respectively, each of the first and second inside channels including a plurality of first LEDs from a subset of the set of LEDs, the subset of LEDs being ranked in a predetermined chromaticity region of the chromaticity regions and ranked in a predetermined luminous flux range of the luminous flux ranges, the chromaticity regions including first and second chromaticity regions, the first chromaticity region being positioned at a center region within the chromaticity range in the chromaticity coordinate system, the second chromaticity region being positioned on a periphery of the first chromaticity region within the chromaticity range in the chromaticity coordinate system such that the second chromaticity region entirely surrounds the first chromaticity region within the chromaticity range in the chromaticity coordinate system, the luminous flux ranges including first and second luminous flux ranges, the first luminous flux range having a larger luminous flux value than the second luminous flux range, the first LEDs being from the subset of LEDs that is ranked in the first chromaticity region and ranked in the first luminous flux range, each of the first and second outside channels including a plurality of second LEDs from the set of LEDs, the second LEDs being only and arbitrarily from outside of the subset of LEDs, the outside of the subset of LEDs including LEDs ranked in the first and second chromaticity regions.

2. The light source unit according to claim 1, wherein the outside of the subset of LEDs includes LEDs ranked in the second chromaticity region and ranked in the second luminous flux range.

3. The light source unit according to claim 2, wherein the first inside channel is located at the center portion of the LED mount bar between the longitudinal center point of the LED mount bar and the first outside channel, the second inside channel is located at the center portion of the LED mount bar between the longitudinal center point of the LED mount bar and the second outside channel.

4. The light source unit according to claim 1, wherein the first inside channel is located at the center portion of the LED mount bar between the longitudinal center point of the LED mount bar and the first outside channel, the second inside channel is located at the center portion of the LED mount bar between the longitudinal center point of the LED mount bar and the second outside channel.

5. A method for making a light source unit, the method comprising:

providing first and second inside channels and first and second outside channels on an LED mount bar, the first and second inside channels being located at a center portion of the LED mount bar such that the first and second inside channels are arranged adjacent to each other on opposite sides of a longitudinal center point of an entire length of the LED mount bar, the first and second outside channels being located at outside portions of the LED mount bar, respectively, with the outside portions being disposed longitudinal outside of the LED mount bar relative to the center portion, respectively;

providing a set of LEDs, the set of LEDs being ranked into a plurality of chromaticity regions within a predetermined chromaticity range in a chromaticity coordinate system and ranked into a plurality of luminous flux ranges according to a luminous flux value of the LEDs, respectively;

selecting a plurality of first LEDs from a subset of the set of LEDs, the subset of LEDs being ranked in a predetermined chromaticity region of the chromaticity regions and ranked in a predetermined luminous flux range of the luminous flux ranges;

mounting the first LEDs on each of the first and second inside channels of the LED mount bar;

selecting a plurality of second LEDs from the set of LEDs; and mounting the second LEDs on each of the first and second outside channels of the LED mount bar, the chromaticity regions including first and second chromaticity regions, the first chromaticity region being positioned at a center region within the chromaticity range in the chromaticity coordinate system, the second chromaticity region being positioned on a periphery of the first chromaticity region within the chromaticity range in the chromaticity coordinate system such that the second chromaticity region entirely surrounds the first chromaticity region within the chromaticity range in the chromaticity coordinate system, the luminous flux ranges including first and second luminous flux ranges, the first luminous flux range having a larger luminous flux value than the second luminous flux range, the first LEDs being from the subset of LEDs that is ranked in the first chromaticity region and ranked in the first luminous flux rang, the selecting of the second LEDs from the set of LEDs includes selecting the second LEDs only and arbitrarily from outside of the subset of LEDs, the outside of the subset of LEDs including LEDs ranked in the first and second chromaticity regions.

6. The light source unit according to claim 1, wherein the first LEDs include LEDs only from the subset of LEDs.

7. The method according to claim 5, wherein the selecting of the first LEDs from the subset of the set of LEDs includes selecting the first LEDs only from the subset of LEDs.

* * * * *